US006351255B1

(12) United States Patent
Ishizuka et al.

(10) Patent No.: US 6,351,255 B1
(45) Date of Patent: Feb. 26, 2002

(54) LUMINOUS DISPLAY AND ITS DRIVING METHOD

(75) Inventors: Shinichi Ishizuka; Tsuyoshi Sakamoto, both of Saitama (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 09/188,377

(22) Filed: Nov. 10, 1998

(30) Foreign Application Priority Data

Nov. 10, 1997 (JP) ..... 9-323795

(51) Int. Cl.[7] ..... G09G 3/30
(52) U.S. Cl. ..... 345/77; 345/78
(58) Field of Search ..... 345/76, 77, 78, 345/82, 83, 204, 90, 91, 92, 94, 95, 208

(56) References Cited

U.S. PATENT DOCUMENTS 5,075,596 A * 12/1991 Young et al. ..... 315/169.3
5,719,589 A * 2/1998 Norman et al. ..... 345/82
5,828,181 A * 10/1998 Okuda ..... 315/169.3
5,838,289 A * 11/1998 Saito et al. ..... 345/79
5,844,368 A * 12/1998 Okuda et al. ..... 315/169.3
5,847,516 A * 12/1998 Kishita et al. ..... 315/169.3
5,856,813 A * 1/1999 Katayama et al. ..... 345/76
5,872,561 A * 2/1999 Figie et al. ..... 345/168
5,923,309 A * 7/1999 Ishizuka et al. ..... 345/82
5,973,456 A * 10/1999 Osada et al. ..... 315/169.1
5,982,345 A * 11/1999 Takayama et al. ..... 345/76
6,028,575 A * 2/2000 Todokoro et al. ..... 345/74

* cited by examiner

*Primary Examiner*—Bipin Shalwala
*Assistant Examiner*—Ricardo Osorio
(74) *Attorney, Agent, or Firm*—Sughrue Mion, PLLC

(57) ABSTRACT

In a luminous display method according to a simple matrix drive system and its driving method in which luminous elements are connected at the intersections of a plurality of anode lines and a plurality of cathode lines which are arranged in matrix form, the cathode lines or the anode lines are employed as scanning lines, while the others are employed as drive lines, and while the scanning lines are scanned with a predetermined period, in synchronization with the scanning operation drive sources are connected to desired drive lines thereby to cause luminous elements to emit lights which are connected at the intersections of the scanning lines and the drive lines; in which, during a period of time before, after the scanning of an optional scanning line is accomplished, the scanning is switched over to the scanning of the next scanning line, an offset voltage is applied to charge the luminous elements.

33 Claims, 12 Drawing Sheets

1
2
3
4
LUMINESCENCE CONTROL CKT
LUMINESCENCE DATA
Vcc (10V)
51
52
53
564
B1
B2
B3
B64
E1.1
E1.2
E1.3
E1.64
r1
E2.1
E2.2
E2.3
E2.64
r2
E3.1
E3.2
E3.3
E3.64
r3
E256.1
E256.2
E256.3
E256.64
r256
A1
A2
A3
A256
VX1
VX3
X
Y
61
62
63
6256
21
22
23
2256
81
82
83
8256
V1
V2
V3
V256
71
72
73
7256

1
2
3
4
LUMINESCENCE CONTROL CKT
LUMINESCENCE DATA
Vcc (10V)
5₁
5₂
5₃
5₆₄
B₁
B₂
B₃
B₆₄
E1.1
E1.2
E1.3
E1.64
r1
E2.1
E2.2
E2.3
E2.64
r2
E3.1
E3.2
E3.3
E3.64
r3
E256.1
E256.2
E256.3
E256.64
r256
A1
A2
A3
A256
Vx1
Vx2
Vx3
Vx256
V1
V2
V3
V256
6₁
6₂
6₃
6₂₅₆
8₁
8₂
8₃
8₂₅₆
2₁
2₂
2₃
2₂₅₆
7₁
7₂
7₃
7₂₅₆

1
2
3
4
LUMINESCENCE CONTROL CKT
LUMINESCENCE DATA
Vcc (10V)
Vcc
r1
r2
r3
r256
V1
V2
V3
V256
VX1
VX2
VX3
VX256
A1
A2
A3
A256
B1
B2
B3
B64
E1.1
E1.2
E1.3
E1.64
E2.1
E2.2
E2.3
E2.64
E3.1
E3.2
E3.3
E3.64
E256.1
E256.2
E256.3
E256.64

LUMINOUS DISPLAY AND ITS DRIVING METHOD

BACKGROUND OF THE INVENTION

1. Field of the Invention

This invention relates to a luminous display using luminous elements such as organic EL (electro-luminescence), and its driving method.

2. Description of the Related Art

Recently, attention has been paid to an organic EL display as a self-luminous type display. Development of organic materials has advanced, and its service life has increased. Furthermore, it is thin, and is high in luminescence, and it is low in power consumption including its back light. Hence, its screen is improved in definition and increased in size.

The organic EL is a capacitive element. Therefore, it suffer from a problem that, in a simple matrix drive system popularly employed as a matrix display drive method, the parastic capacitance of the luminous element is charged, and the resultant charge makes the luminescence of the element insufficient.

This problem will be described concretely below:

A drive method shown in FIG. 6 is called "a simple matrix drive system. Anode lines A1 through A256 and cathode lines B1 through B64 are arranged in matrix. At the intersections of the anode lines and the cathode lines thus connected in matrix, luminous elements E1.1 through E256.64 are connected. The anode lines or the cathode lines are scanned at predetermined time intervals, while, in synchronization with this scan, the other lines are driven with constant currents 21 through 2256 which are employed as drive sources, so that the luminous elements at the desired (optional) intersections are caused to emit light. Each of the constant current sources 21 through 2256 supplies a constant current I.

In the case of FIG. 6, the luminous elements E11 and E12 are turned on. That is, the scanning switch 51 is switched over to 0V (side), and the cathode line B1 is scanned.

For the remaining cathode lines B2 through B64, the scanning switch 52 through 564 function, to apply reverse bias voltage Vcc (10V) to them B2 through B64.

The application of the reverse bias voltage is to prevent current supplied from the constant current sources 21 through 2256 from being applied to the cathode lines which are not scanned, It is preferable that the value Vcc is substantially equal to the voltage value applied between the luminous elements to cause the luminous elements to emit light at a desired instantaneous brightness; that is, a voltage of the luminous element which are connected between a constant current source and ground.

The anode lines A1 and A2 are connected through drive switches 61 and 62 to the constant current sources 21 and 22, and shunt switches 71 and 71 are kept opened. For the remaining anode lines A3 through A256, the constant current sources are opened, and the shunt switches 73 through 7256 are at ground potential.

Accordingly, in the case of FIG. 6, the luminous elements E1.1 and E2.1 are biased forwardly, so that drive currents from the constant current sources flow as indicated by the arrows in FIG. 6, whereby only two luminous elements E1.1 and E2.1 emit light.

The operations of the scanning switches 51 through 564, the drive switches 61 through 6256, the shunt switch 71 through 7256 are controlled by a luminescence control circuit 4+ to which luminous data are applied.

With the aid of the scanning switches 52 through 564, reverse bias voltage is applied to first terminals of the luminous elements connected at the intersections of the cathode lines B2 through B64 and the anode lines A1 and A2, while the constant current sources 21 and 22 supply a voltage, which is substantially equal to the reverse bias voltage, to the second (remaining) terminals thereof. Therefore, no current flows in the luminous elements. Accordingly, no parastic capacitances of the luminous elements are charged.

Reverse bias voltage is applied to the luminous elements connected at the intersections of the cathode lines B through B64 and the anode lines A3 through A256. Therefore, the parastic capacitances (the capacitors shaded) of the luminous elements are reversely charged as indicated in FIG. 6 (the potential on the side of cathodes of the element being higher).

When, under the condition that the parastic capacitances are reversely charged, the cathode lines are scanned to cause the next luminous element to emit light, then the period of time required for the next luminous element to activate, and accordingly, it is impossible to perform a high speed scanning operation. This will be described with reference to FIGS. 7A and 7B.

FIGS. 7A and 7B show only the luminous elements E3,1 through E3,64 connected to the anode line A3 in FIG. 6. FIG. 7A is for a description of the scanning of the cathode line B1, and FIG. 7B is for a description of the scanning of the cathode line B2. In this connection, let us consider the case where, when the cathode line B1 is scanned, the light emission of the luminous element E3,1 is not carried out, and when the cathode line B2 is canned, the light emission of the luminous element E3,2 is carried out.

As shown in FIG. 7A, in the case where, when the cathode line B1 is scanned, the anode line A3 is not driven, the luminous elements E3,2 through E3,64 (other than the luminous element E3,1) connected to the cathode line B1 which is being scanned are charged as shown in FIG. 7A by the reverse bias voltage Vcc applied to the cathode lines B2 through B64.

As shown in FIG. 7B, if, when the scanning is shifted to the cathode line B2, the anode line A3 is driven to cause the luminous element E3,2 to emit light, then not only the parastic capacitance of the luminous element E3,2 is charged, but also current flows to the parastic capacitances of the luminous elements E3,3 through E3,64 connected to the other cathode lines B3 through B64 as indicated by the arrows; that is, those parastic capacitances are charged.

On the other hand, a luminous element has a characteristic that its luminescent brightness changes with a voltage across it. Hence, if the voltage across it is not increased to a predetermined value, the steady light emission (the light emission with a desired instantaneous brightness) thereof is not achieved.

In the case of the conventional drive method, as shown in FIGS. 7A and 7B, when the anode line A3 is driven to cause the luminous element E3,2 to emit light which is connected to the cathode line B2, then not only the parastic capacitance of the luminous element E3,2 to be caused to emit light but also the other luminous elements E3,3 through E3,64 connected to the anode line A3 are charged. Therefore, it takes time to charge the parastic capacitance of the luminous element E3,2 to be caused to emit light; that is, it is impossible to quickly increase the voltage across the luminous element E3,2 to a predetermined value which is connected to the cathode line B2.

Accordingly, the conventional method is disadvantageous in that the time required for a luminous element to emit light is slow, and it is impossible to perform a high speed scanning operation.

In order to solve this problem, the present Applicant has proposed the following drive method under Japanese Patent Application No. 38393/1996: As shown in FIG. 8, during the period of time between the accomplishment of a scanning operation and the shifting the scanning operation to the next cathode line, all the drive switch 61 through 6256 are turned off, all the scanning switches 51 through 564 and all the shunt switches 71 through 7256 are switched over to 0V side, so that the resetting operation with 0V is effected, whereby the parastic capacitances of the luminous elements are discharged. The proposed method functions as described above.

In the above-described conventional drive method, the parastic capacitances of the luminous elements E3,2 through E3,64 charged by the reverse bias voltage Vcc during the scanning of the cathode line B1 is discharged before the scanning is shifted to the cathode line B2. Therefore, at the moment the scanning is shifted to the cathode line B2, the circuit is as shown in FIG. 9. In this case, the parastic capacitances of all the luminous elements have been discharged. Therefore, currents from a plurality of routes shown in FIG. 9 flow to the luminous element E3,2 to be caused to emit light next, so that the luminous element E3,2 is quickly caused to emit light.

FIGS. 10 and 11 show another conventional drive method, which is different from the above-described one in a luminous element resetting operation.

In the drive method, drive switches 61 through 6256 are 3-contact type change-over switches. The first contacts are connected to nothing (open), the second contacts are connected to constant current sources 21 through 2256, and the third contacts are connected to the power source Vcc=10V.

In the case where the luminous elements E1,1 and E2,1, the state of the circuit is as shown in FIG. 10, being the same as that shown in FIG. 6.

The two luminous elements E1,1 and E2,1 are caused to emit light. And before, in order to cause the next luminous element to emit light, the cathode line B2 is scanned, as shown in FIG. 11 all the shunt switches 71 through 7256 are turned off, and all the scanning switches 51 through 564 are switched over to the reverse bias voltage side, and all the drive switches 61 through 6256 are switched over to the third contact side.

As a result, all the anode lines A1 through A256, and all the cathode lines B1 through B64 are shunt with the constant voltage source, so that the parastic capacitances of all the luminous elements are instantaneously discharged.

That is, in the above-described second conventional method, during the period of time between the accomplishment of the scanning of a (an optional) cathode line and the shifting of the scanning operation to the next cathode line, all the luminous elements are reset so as to discharge the parastic capacitances of the luminous elements. The time between the supplying of drive current to a luminous element to be caused to emit light next and the emission of light thereof is reduced; that is, a high speed scanning operation is carried out.

As the display panel is increased in size and in definition, the number of luminous elements is increased, and the cathode lines and the anode lines connecting those luminous elements is elongated and thinned. Since the cathode line is made of a metal line, usually it has a low resistance. In the case where the cathode line and the anode line are elongated and thinned, then they are increased in resistance as much.

The above-described drive method pays no attention to the resistance of the cathode lines; however, if the resistance is increased, the following problem which cannot be disregarded is involved.

This problem will be described with reference to FIG. 12. FIG. 12 shows a part of FIG. 6.

In FIG. 12, the resistance r1 of the cathode lines B1 through B64 between the scanning switches 51 through 564 and the luminous elements E1,1 through E1,64 can be regarded as about zero (0). The resistance of the cathode lines are gradually increased in proportion to the distances from the scanning switches 51 through 564. And its resistance r 256 becomes maximum between the scanning switches 51 through 564 and the luminous elements E256,1 through E256,64.

Let us consider the case where the parastic capacitances of the luminous elements are discharged by the above-described resetting operation, the scanning is shifted from the cathode line B1 to the cathode line B2, and in order to cause the luminous elements E1,2 and E2,256 to emit light the anode lines A1 through A256 are connected to the constant current sources 21 through 2256.

When the scanning is shifted, current flows in the luminous element E1,2 from the side of the luminous elements E1,1, and E1,3 through E1,64; however, since the resistance of the cathode line B2 between luminous element E1,2 and the scanning switch 52 is about zero (0), there is no voltage drop due to the resistance of the cathode line B2. Therefore, the voltage applied across the luminous element E1,2 becomes approximately Vcc immediately, and the latter E1,2 is charged in correspondence to Vcc. Hence, the voltage across the luminous element E1,2 can be increased to the desired value Vcc, and immediately the light emission is carried out with a desired instantaneous luminance.

On the other hand, when current flows into the luminous element E256,2 from the side of the luminous elements E256,1 and E256,3 through E256,64 after the scanning is switched, a—voltage drop V256 is caused by the resistance r256 of the cathode line B2.

Therefore, the voltage across the luminous element E256,2 is Vcc−V256, and the parastic capacitance of the latter E256,2 is charged as much. Accordingly, immediately after the switching of the scanning the voltage across the luminous element E256,2 is not the predetermined value yet, and therefore the light emission is not carried out with a desired instantaneous luminance. In order to perform the light emission at the desired instantaneous luminance, the current supplied from the constant current source 2256 must be applied thereto until the voltage across the luminous element reaches the predetermined value Vcc. For this purpose, all the luminous elements E256,1 through E256,64 must be charged until the potential of the anode line A256 reaches Vcc+V256; however, this operation will take a lot of time.

As is apparent from the above description, the luminous element E256,2 cannot obtain a sufficiently high luminance during its selected period, and is deviated in luminance from the luminous element E1,2. Those factors makes the screen unclear.

As was described above, because of the resistance of the cathode lines, the element located far from the scanning switches 51 through 564 is insufficient in luminance when compared with the element located near those scanning switches. That is, the display panel is not uniform in the distribution of luminance.

SUMMARY OF THE INVENTION

In view of the foregoing, an object of the invention is to provide a luminous display which realizes a display panel in which the elements are uniform in luminance, and to provide a drive method thereof.

According to a first aspect of the invention, there is provided a method of driving a luminous display in a simple matrix drive system in which luminous elements are connected at the intersections of a plurality of anode lines and a plurality of cathode lines which are arranged in matrix form, the cathode lines or the anode lines are employed as scanning lines, while the others are employed as drive lines, and while the scanning lines are scanned with a predetermined period, in synchronization with the scanning operation drive sources are connected to desired drive lines to cause luminous elements to emit lights which are connected at the intersections of the scanning lines and the drive lines, said method comprising the step of:

scanning one scanning line; and applying an offset voltage to the luminous elements to charge the luminous elements during a period of time when the scanning of the one scanning line is switched over to the scanning of a succeeding scanning line after the scanning of the one scanning line has been completed.

According to a second aspect of the invention, there is provided a method of driving a luminous display according to the first aspect, wherein said offset voltage applying step comprises the steps of:

grounding the scanning lines; and connecting the drive lines to voltage sources different from the drive sources.

According to a third aspect of the invention, there is provided a method of driving a luminous display according to the first aspect, wherein the offset voltages are set to values corresponding to drop voltages across resistances between the luminous elements of the scanning lines and the ends of the scanning lines.

According to a fourth aspect of the invention, there is provided a method of driving a luminous display according to the first aspect; wherein the offset voltages are set to values corresponding to resistances between the luminous elements and the ends of the scanning lines.

According to a fifth aspect of the invention, there is provided a method of driving a luminous display according to the first aspect, wherein said offset voltage applying step comprises the step of applying bias voltages to the scanning lines which are not scanned are applied, of the plurality of scanning lines; and grounding the drive lines which are not driven, of the plurality of drive lines.

According to a sixth aspect of the invention, there is provided a method of a luminous display according to the first aspect, wherein the luminous elements are organic EL elements having parastic capacitances.

According to a seventh aspect of the invention, there is provided a luminous display in a simple matrix drive system, said display comprising:

a plurality of anode lines;

a plurality of cathode lines, said cathode lines and said anode lines being arranged in matrix form, ones of said cathode lines and said anode lines being employed as scanning lines, and the others being employed as drive lines;

a plurality of luminous elements connected at intersections of said anode lines and said cathode lines;

bias voltage applying means for applying bias voltage to the scanning lines, each of the scanning lines is connected to one of said voltage applying means and the ground;

constant current sources for supplying drive currents to said luminous elements; and voltage sources for applying offset voltages to said luminous elements, said anode lines being connected to one of said constant current sources, said voltage sources and the ground;

wherein said scanning lines are scanned with a predetermined period, desired drive lines are driven in synchronization with the scanning operation to cause said luminous elements to emit lights.

According to an eighth aspect of the invention, there is provided a luminous display according to the seventh aspect, wherein during a period of time before, after the scanning of an optional scanning line is accomplished, the scanning is switched over to the scanning of the next scanning line, the plurality of drive lines are connected to the voltage sources, while the scanning lines are grounded, so that the luminous elements are charged.

According to a ninth aspect of the invention, there is provided a luminous display according to the seventh aspect; wherein the offset voltages are set to values corresponding to drop voltages across resistances between the luminous elements of the scanning lines and the ends of the scanning lines.

According to a tenth aspect of the invention, there is provided a luminous display according to the ninth aspect; wherein the voltage sources are variable voltage sources, and comprises:

voltage determining means which, according to the light emission states of all the luminous elements connected to the cathode line which is to be scanned next, determine offset voltages which are to be applied to those luminous elements; and voltage control means for controlling supply voltage values of the variable voltage sources so as to apply offset voltages which are determined by the offset voltage determining means.

According to an eleventh aspect of the invention, there is provided a luminous display according to the seventh aspect, wherein the offset voltages are set in correspondence to resistances between the luminous elements and the ends of the scanning lines.

According to a twelfth aspect of the invention, there is provided a luminous display according to the seventh aspect, wherein during a scanning period of the scanning lines, the lines which are not scanned are connected to the bias voltage applying means, and the lines which are not driven are grounded.

According to a thirteenth aspect of the invention, there is provided a luminous display according to the seventh aspect, wherein the luminous elements are organic EL elements having capacitances.

In the luminous display driving method according to a simple matrix drive system in which luminous elements are connected at the intersections of a plurality of anode lines and a plurality of cathode lines which are arranged in matrix form, the cathode lines or the anode lines are employed as scanning lines, while the others are employed as drive lines, and while the scanning lines are scanned with a predetermined period, in synchronization with the scanning operation drive sources are connected to desired drive lines thereby to cause luminous elements to emit lights which are connected at the intersections of the scanning lines and the drive lines; according to the invention, during a period of time before, after the scanning of an optional scanning line is accomplished, the scanning is switched over to the scanning of the next scanning line, an offset voltage is applied to charge the luminous elements. Hence, the fluctuation in the light emission start time of the luminous elements which is due to the resistances of the cathode lines is minimized, and the luminous display is displayed so that the person is able to observe the display with ease.

Furthermore, in the luminous display according to a simple matrix drive system in which luminous elements are connected at the intersections of a plurality of anode lines and a plurality of cathode lines which are arranged in matrix form, the cathode lines or the anode lines are employed as scanning lines, while the others are employed as drive lines, and while the scanning lines are scanned with a predetermined period, in synchronization with the scanning operation drive sources are connected to desired drive lines thereby to cause luminous elements to emit lights which are connected at the intersections of the scanning lines and the drive lines; according to the invention, each of the scanning lines is connectable to bias voltage applying means adapted to apply bias voltage or ground, and the anode lines are connectable to one selected from a group consisting of constant current sources adapted to supply drive currents to the luminous elements, voltage sources adapted to apply offset voltages to the luminous elements, and ground. Hence, the fluctuation in the light emission start time of the luminous elements which is due to the resistances of the cathode lines is minimized, and the luminous display is displayed so that the operator is able to observe the display with ease.

DETAILED DESCRIPTION OF THE PREFERRED EMBODIMENTS

Figure 1:
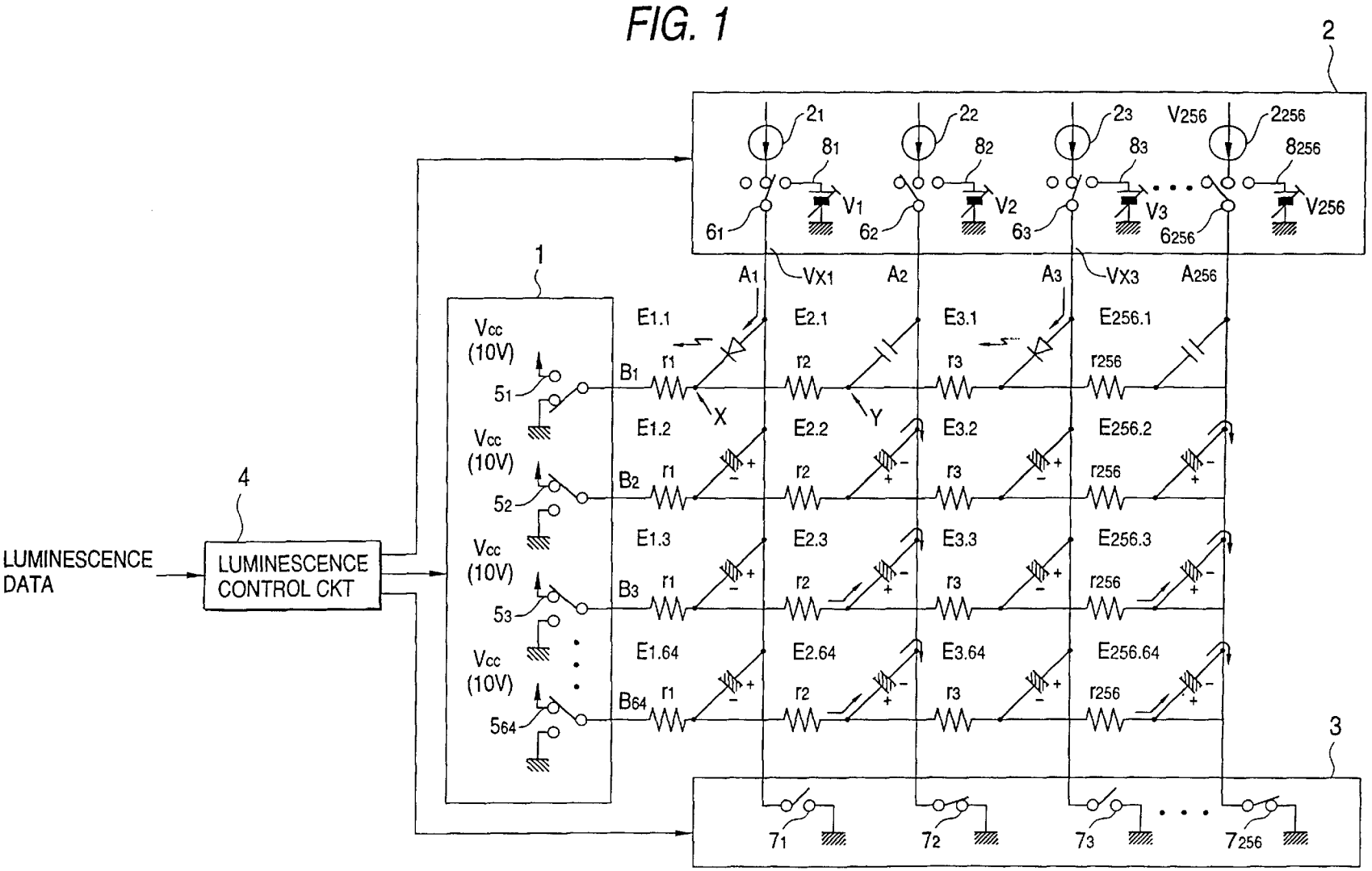
FIG. 1 is an explanatory diagram for a description of a luminous display, which constitutes an embodiment of the invention, and the first step of its driving method.

An embodiment of the invention will be described with reference to FIGS. 1 through 5. Those figures shows a luminous element drive device according to the invention. In FIGS. 1 through 5, parts corresponding functionally to those already described with reference to the prior art (FIGS. 6 through 12) are therefore designated by the same reference numerals or characters. As shown in FIGS. 1 through 5, drive lines, namely, anode lines A1 through A256, and scanning lines, namely, cathode lines B1 through B64 are arranged in matrix. Luminous elements E1,1 through E256, 64 are connected at the intersections of those cathode and anode lines. Reference numeral 1 designates a cathode line scanning circuit; 2, an anode line drive circuit; 3, an anode reset circuit; and 4, a light emission control circuit.

The cathode line scanning circuit 1 has scanning switches 51 through 564 which scan the cathode lines B1 through B64 one after another. First terminals of the scanning switches 51 through 564 are connected to a power source voltage, namely, a reverse bias voltage Vcc (10V), and the remaining (second) terminals are grounded.

The reverse bias voltage Vcc is such that, similarly as in the case of the prior art, in order to cause the luminous elements to emit light with a desired instantaneous luminance, the voltage value applied between the luminous elements is the same.

The anode drive circuit 2 comprises drive sources, namely, current sources 21 through 2256, and drive switches 61 through 6256 to select the anode lines A1 through A256.

The drive switches 61 through 6256 are 3-contact change-over switches. The first contacts are connected to nothing, (open), the second contacts are connected to current sources 21 through 2256, and the third contacts are connected to variable voltage sources 81 through 8256 to apply offset voltages.

The anode reset circuit 3 comprises shunt switches 71 through 7256 to ground the anode lines A1 through A256. The on-off operations of the scanning switches 51 through 564, the drive switches 61 through 6256, and the shunt switches 71 through 7256 are controlled by the light emission control circuit 4.

In FIG. 1, the resistances r1 through r256 are resistances between the contacts of the luminous elements and the cathode lines and the cathode lines and the luminous elements which are connected adjacent to the same cathode lines as the luminous elements are connected. For instance, the resistance between the contact x of the luminous element E1,1 and the cathode line B1 and the contact y of the luminous element E2,1 and the cathode line B1 is designated by r2.

Those resistances r1 through r256 are each r in value.

A method of driving the luminous elements in the embodiment of the invention will be described with reference to FIGS. 1 through 5. For a description of the driving method, it is assumed that after the cathode line B1 is scanned to cause two luminous elements E1,1 and E3,1 to emit light, the cathode line B2 is scanned to cause the luminous elements E2,2 and E3,2 to emit light.

In addition, for convenience in description, a luminous element emitting light is indicated by a diode mark, and a luminous element emitting no light is indicated by a capacitor mark.

In FIG. 1, the scanning switch 51 is switched over to the ground potential side, so that the cathode line B1 is scanned. With the aid of the scanning switches 52 through 564, a reverse bias voltage is applied to the other cathode lines B2 through B64. With the aid of the drive switches 61 and 63, the anode lines A1 and A3 are connected to the current sources 21 and 23, and the shunt switches 71 and 73 are opened.

On the other hand, with the aid of the drives switches 62 and 64 through 6256, the other anode lines A2 and A4 through A256 are disconnected from the current sources 22 and 24 through 2256 while they are grounded with the aid of the shunt switches 72 and 74 through 7256.

Accordingly, in the case of FIG. 1, only the luminous elements E1,1 and E3,1 are biased forwardly, and drive current from the current sources 21 and 23 flows thereinto in the directions of the arrows, so that only the luminous elements E1,1 and E3,1 emit light.

In this case, the potentials of the driven anode lines A1 and A3 are V×1 and V×3, respectively—V×1<V×3.

The luminous elements E1,2 through E1,64 and E32 through E364 at the intersections of the cathode lines B2 through B64 and the driven anode lines A1 and A3, are charged positive. The positive charges are charged by the variable voltage sources 81 and 83 before the scanning of the cathode line B1 (described later).

Owing to this charging operation, the inter-element voltage between the luminous elements E1,2 through E1,64 is V×1−Vcc, and therefore no current flows to those elements.

Similarly, the inter-element voltage between the luminous elements E3,2 through E3,64 is V×3−Vcc, and therefore no current flows to those elements.

The parastic capacitances of the luminous elements at the intersections of the cathode lines B2 through B64 which are not scanned and the anodes A2 and A4 which are not driven are applied with reverse bias voltage with the aid of the scanning switches 52 through 564, and are charged with the aid of the shunt switches 72 and 74 through 7256 so that their polarities are as shown in FIG. 1.

Next, before, after the line scanning period, the next line scanning operation is started, an offset voltage application is carried out.

Figure 2:
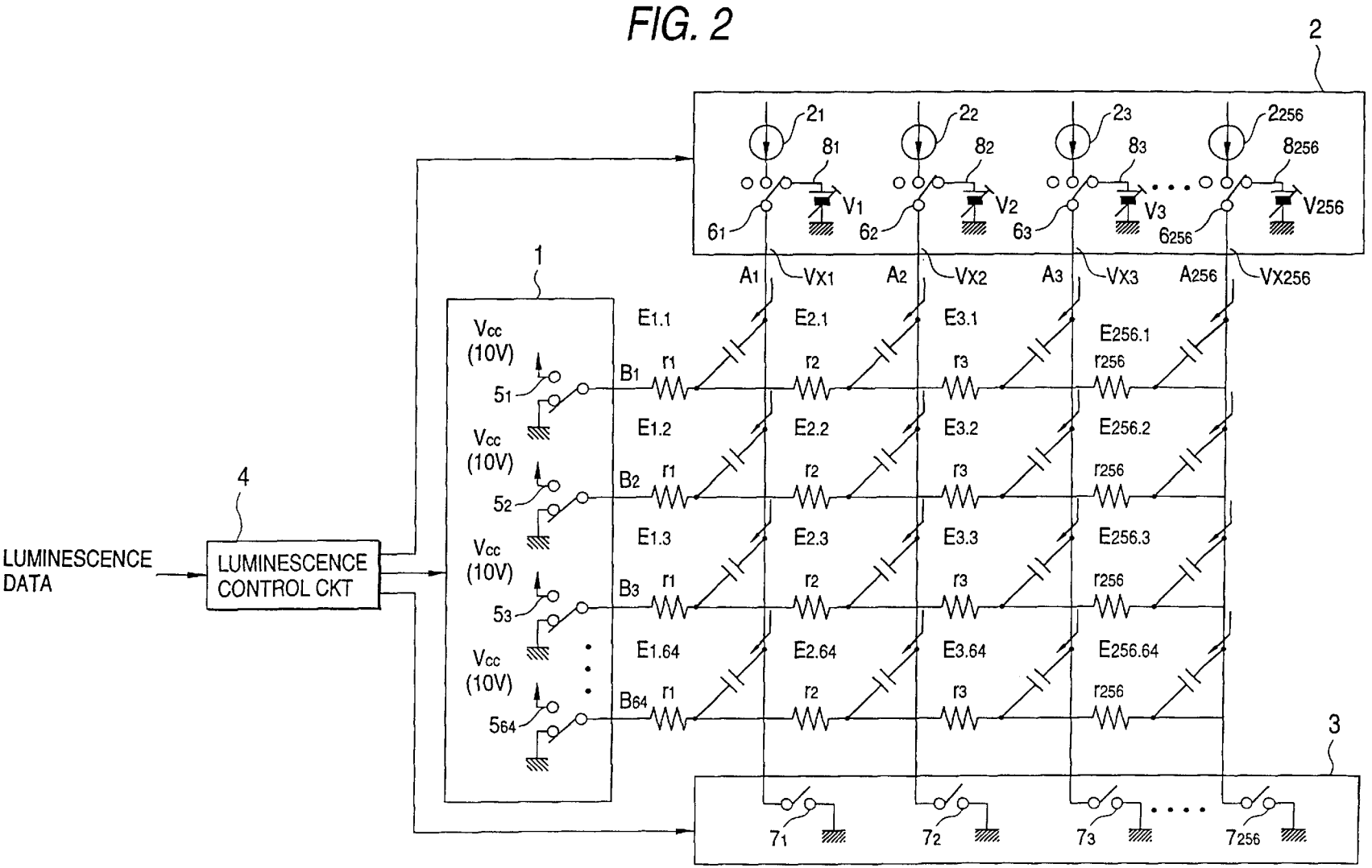
FIG. 2 is an explanatory diagram for a description of the luminous display, which constitutes the embodiment of the invention, and the second step of its driving method.

More specifically, as shown in FIG. 2, the scanning switches 51 through 564 are operated to ground all the cathode lines B1 through B64, and the drive switches 61 through 6256 are operated to switch each of the anode lines A1 through A256 to the third contact side so as to be connected to the variable voltage sources 81 through 8256. And all the shunt switches 71 through 7256 are turned off.

Figure 3:
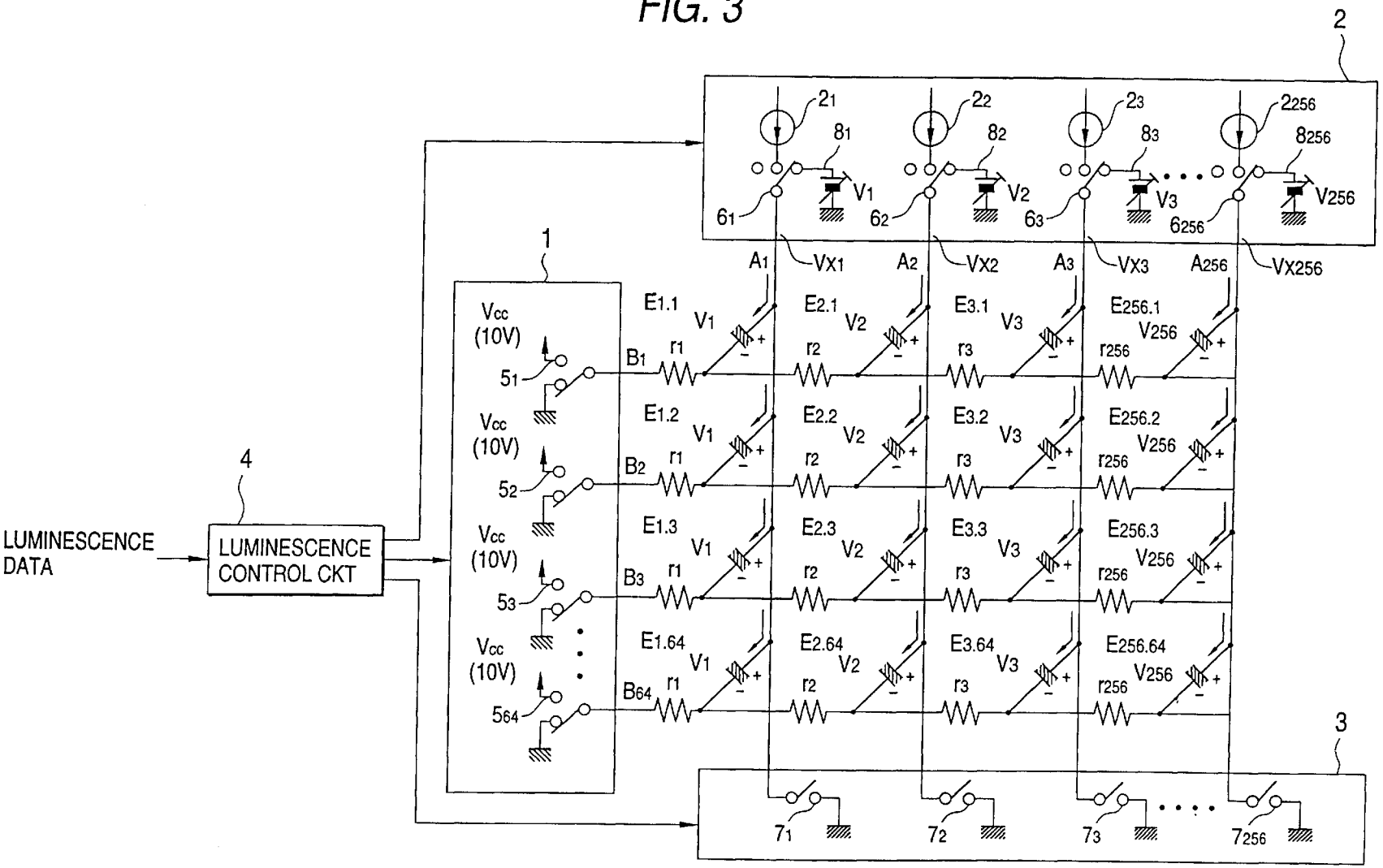
FIG. 3 is an explanatory diagram for a description of the luminous display, which constitutes the embodiment of the invention, and the third step of its driving method.

The offset voltages V1 through V256 applied by the variable voltage sources has been set to values (described later) in advance, whereby the parastic capacitances of the luminous elements are charged with positive charges according to the offset voltages V1 through V256. For instance, positive charge is charged in the luminous element E2,2 so that the inter-element voltage be V3. This state is as shown in FIG. 3. Means for determining the offset voltages will be described later.

Next, the scanning is shifted to the cathode line B2 to cause the luminous elements E2,2 and E3,2 to emit light. This will be described with reference to FIGS. 4 and 5.

Figure 4:
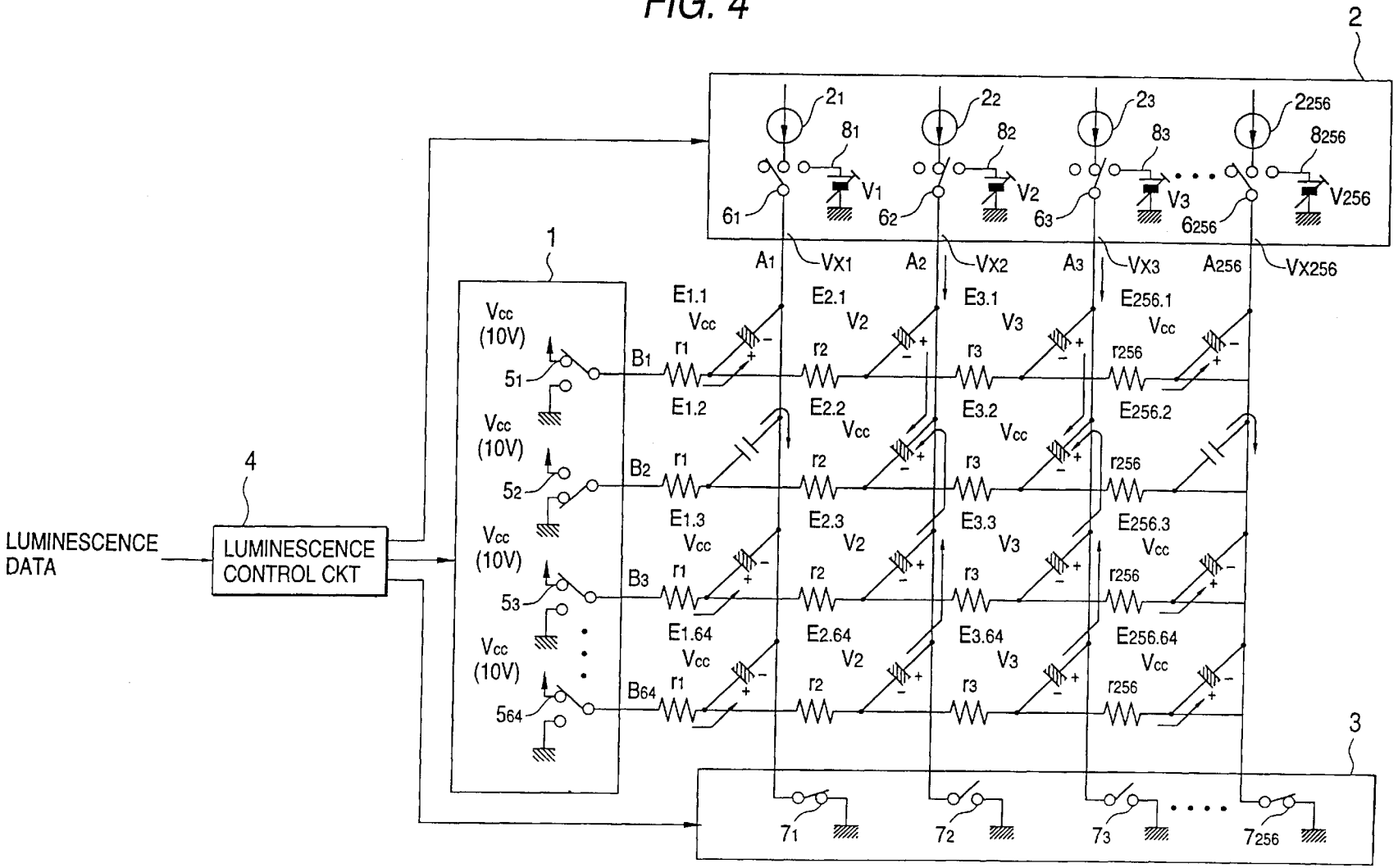
FIG. 4 is an explanatory diagram for a description of the luminous display, which constitutes the embodiment of the invention, and the fourth step of its driving method.
Figure 5:
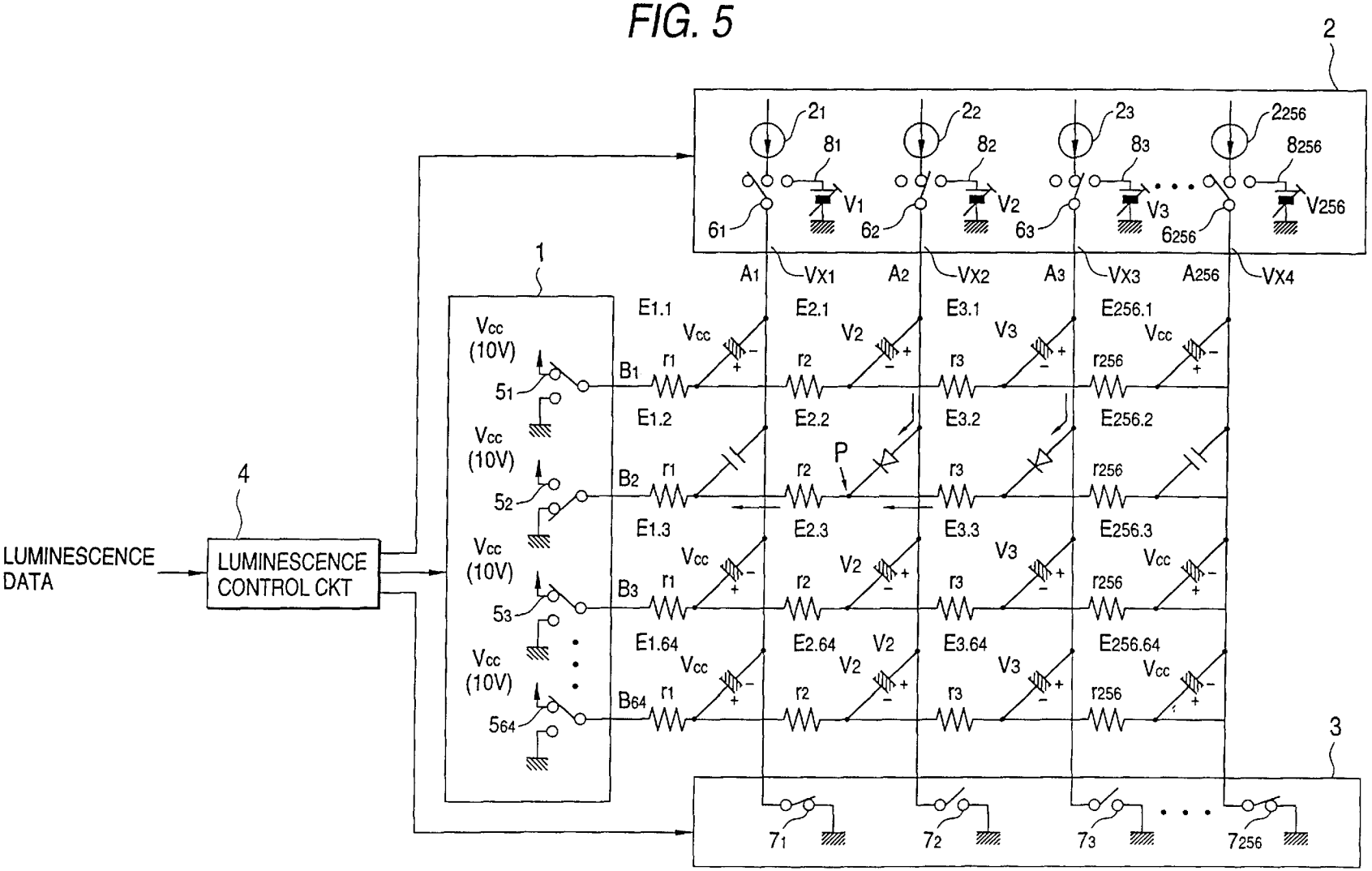
FIG. 5 is an explanatory diagram for a description of the luminous display, which constitutes the embodiment of the invention, and the fifth step of its driving method.
Figure 6:
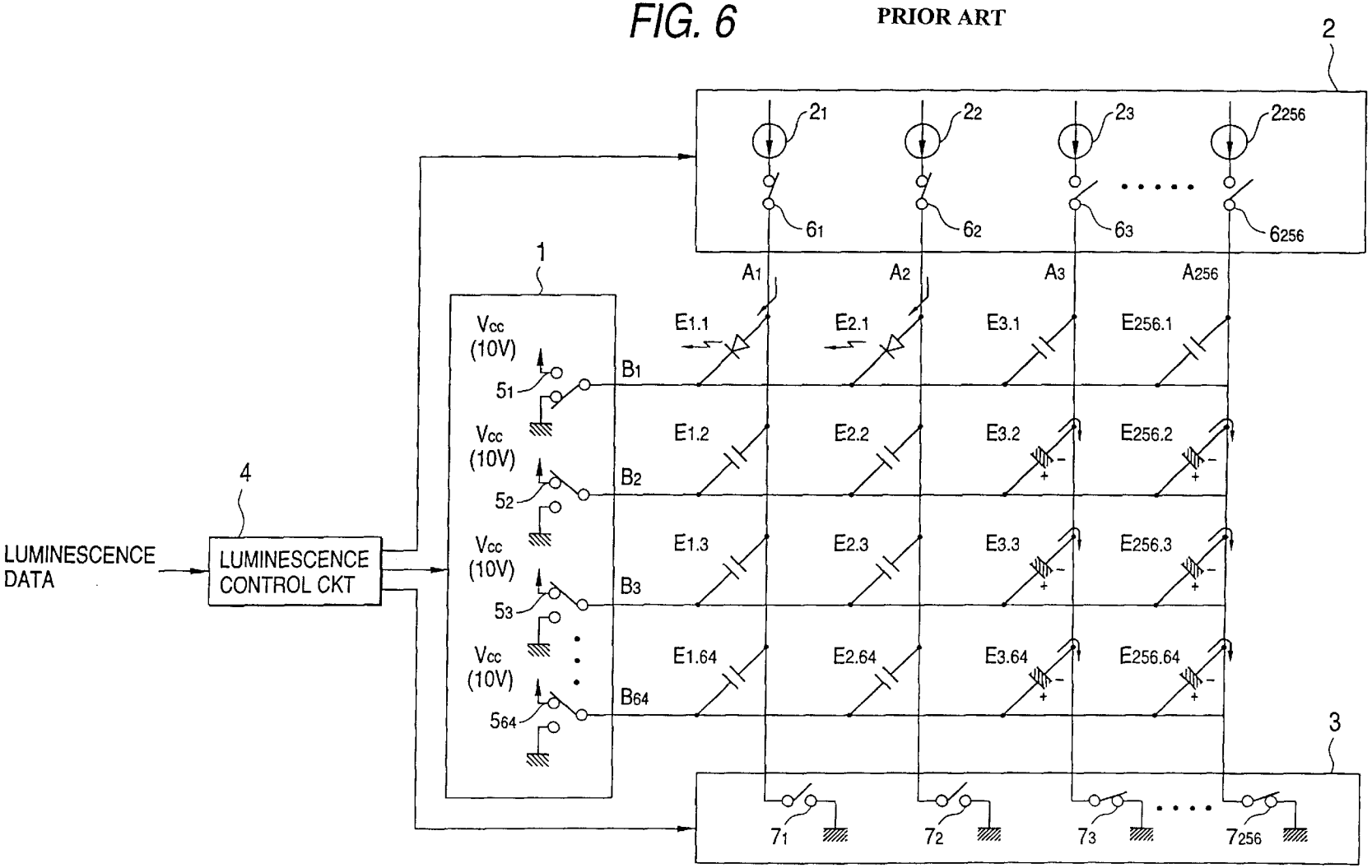
FIG. 6 PRIOR ART
FIG. 6 is a diagram for a description of a conventional luminous display and its driving method.
Figure 7A:
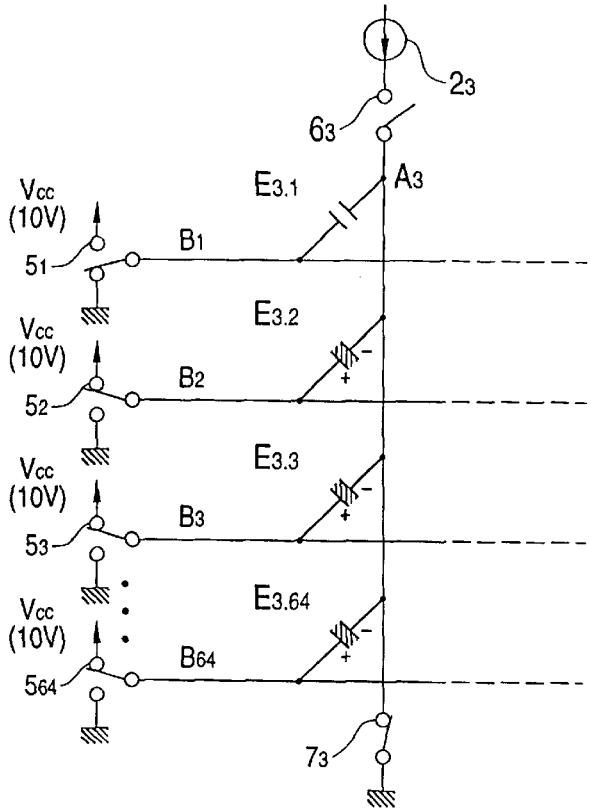
FIG. 7A PRIOR ART
FIGS. 7A and 7B are diagrams for a description of the conventional luminous display and its driving method.
Figure 7B:
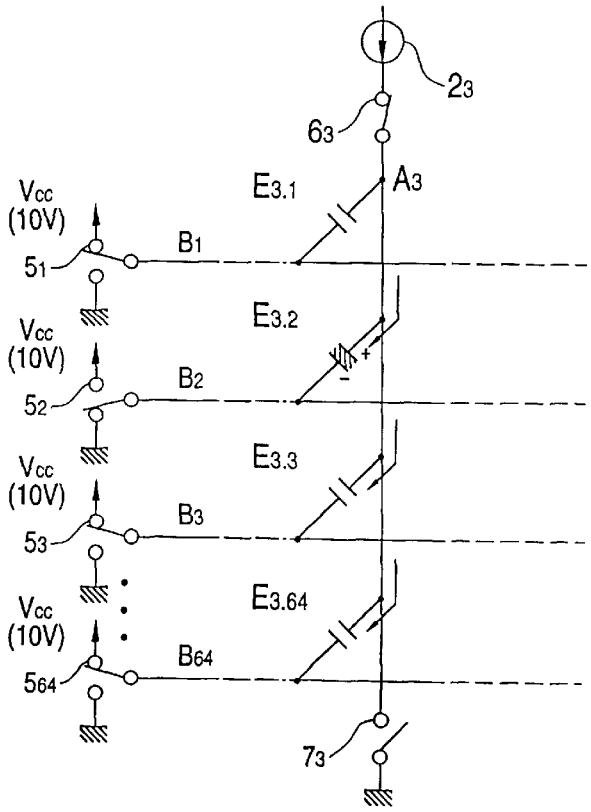
FIG. 7B PRIOR ART
Figure 8:
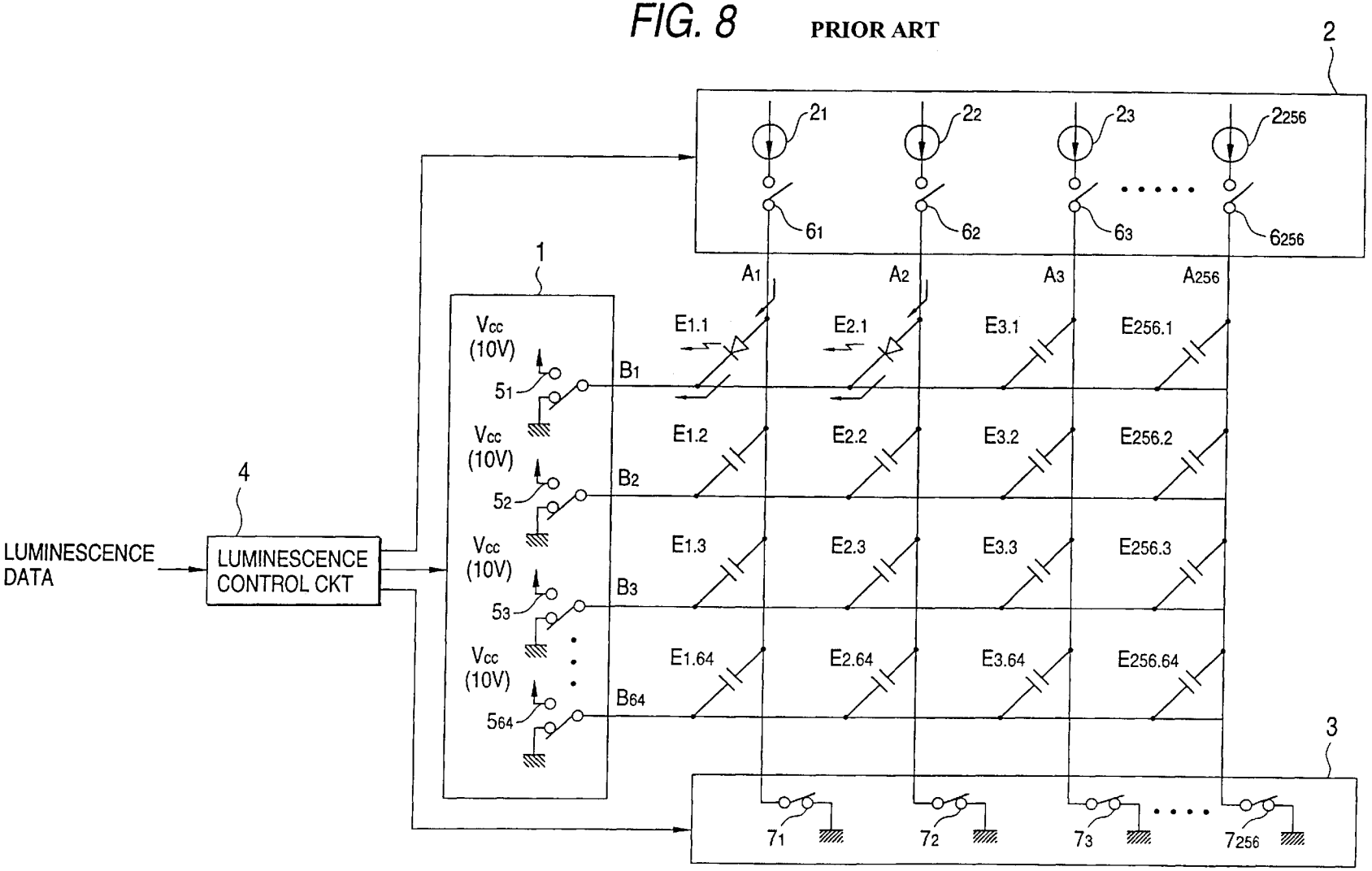
FIG. 8 PRIOR ART
FIG. 8 is a diagram for a description of the conventional luminous display and its driving method.
Figure 9:
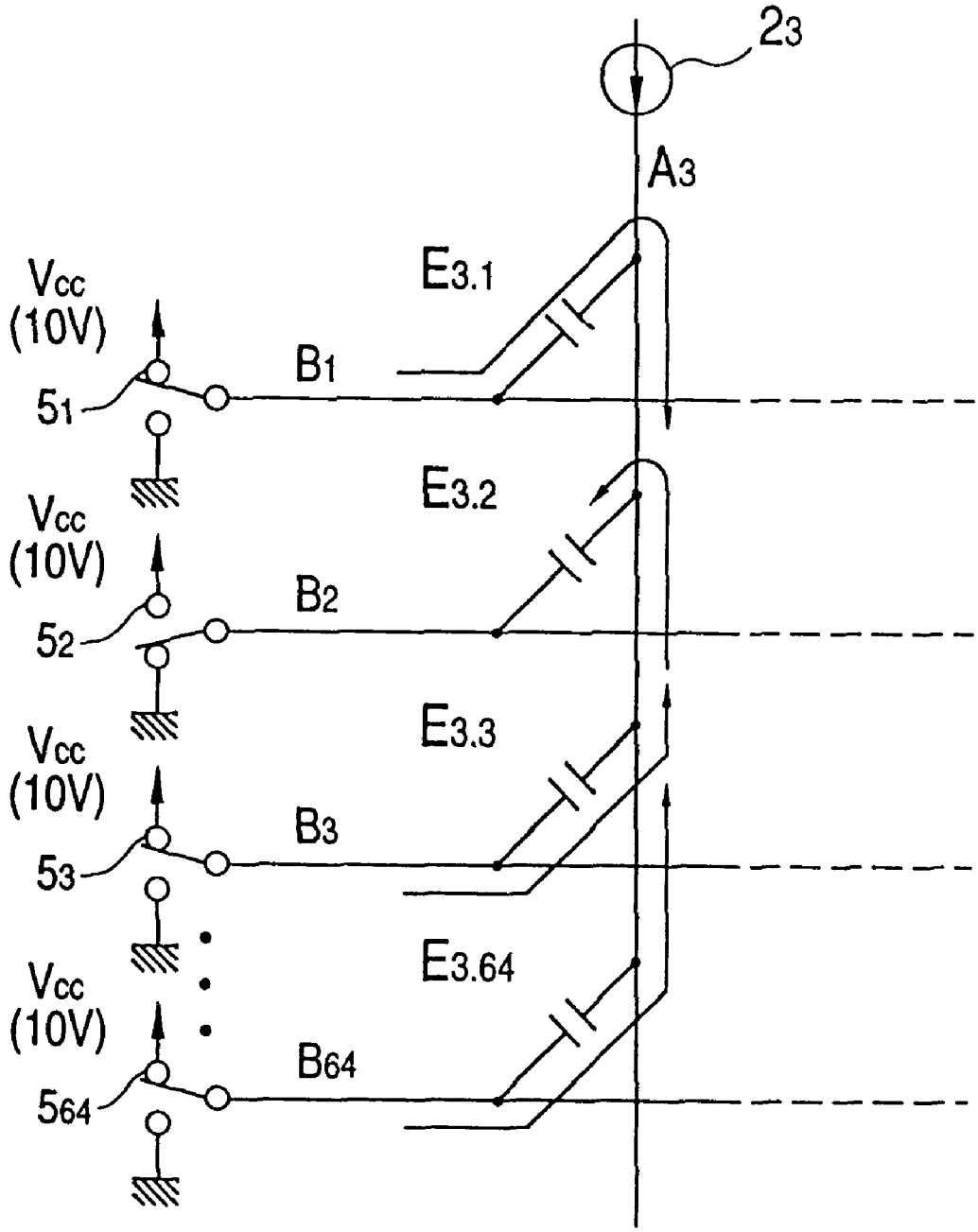
FIG. 9 PRIOR ART
FIG. 9 is a diagram for a description of the conventional luminous display and its driving method.
Figure 10:
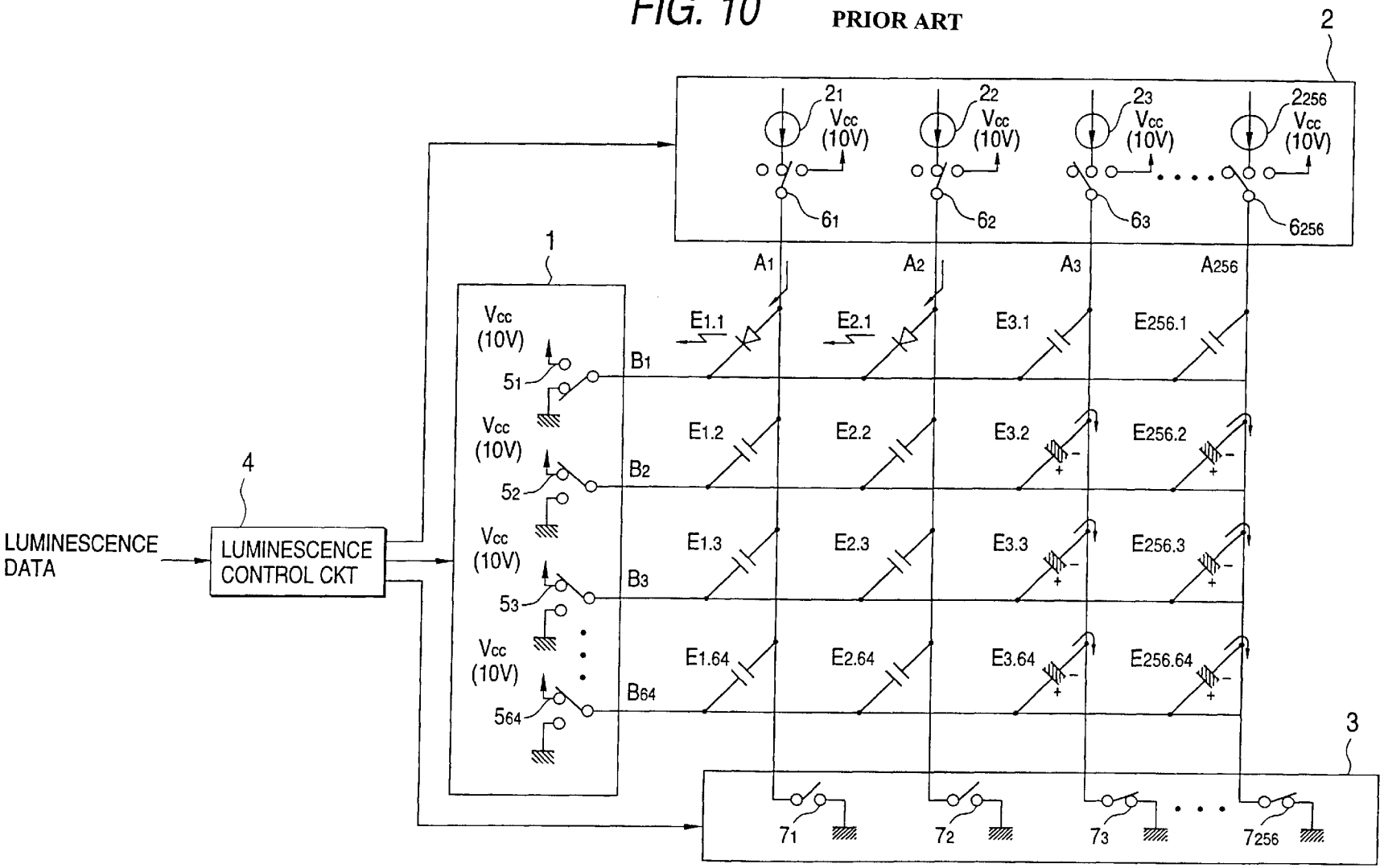
FIG. 10 PRIOR ART
FIG. 10 is a diagram for a description of the conventional luminous display and its driving method.
Figure 11:
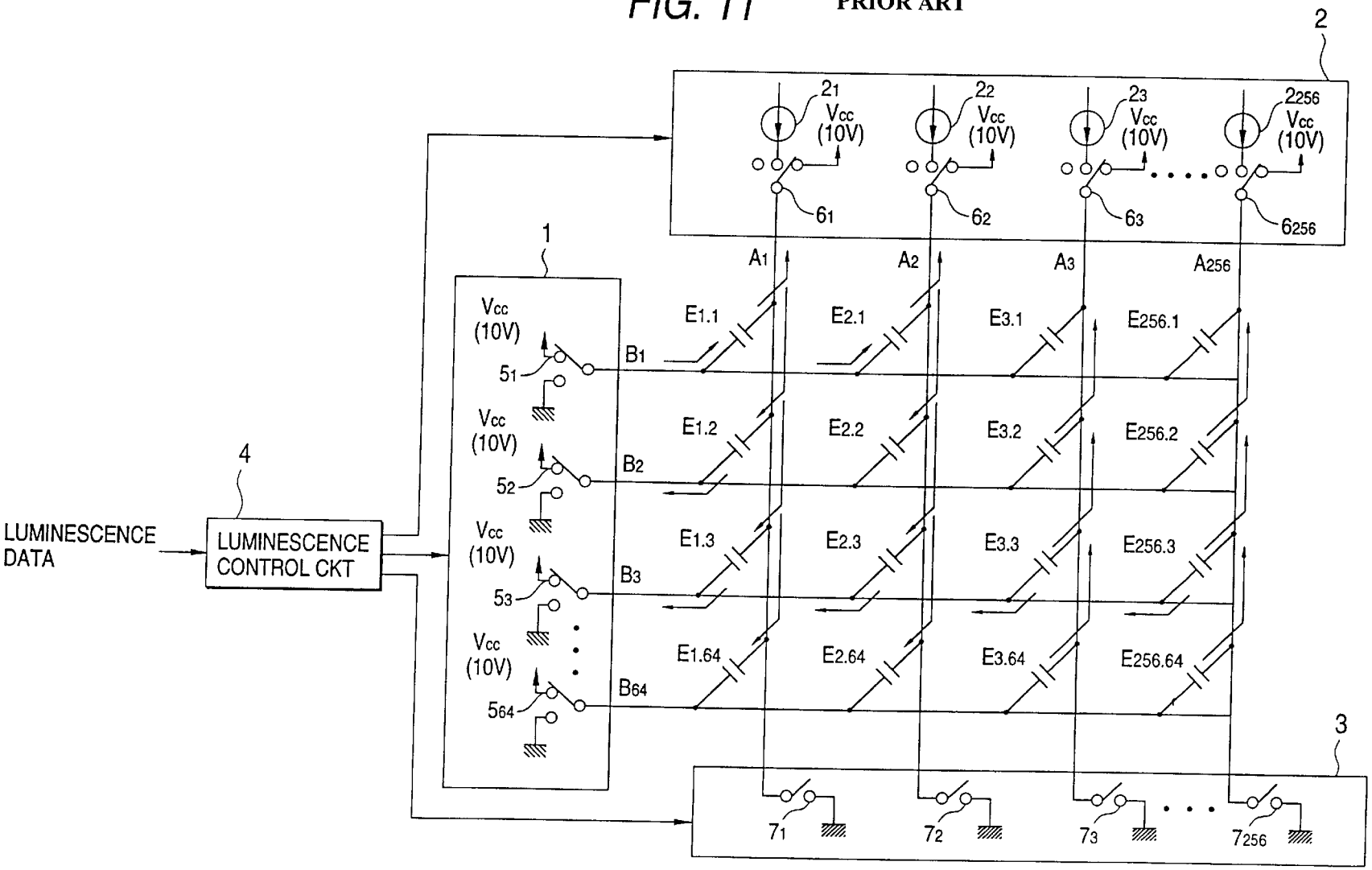
FIG. 11 PRIOR ART
FIG. 11 is a diagram for a description of the conventional luminous display and its driving method.
Figure 12:
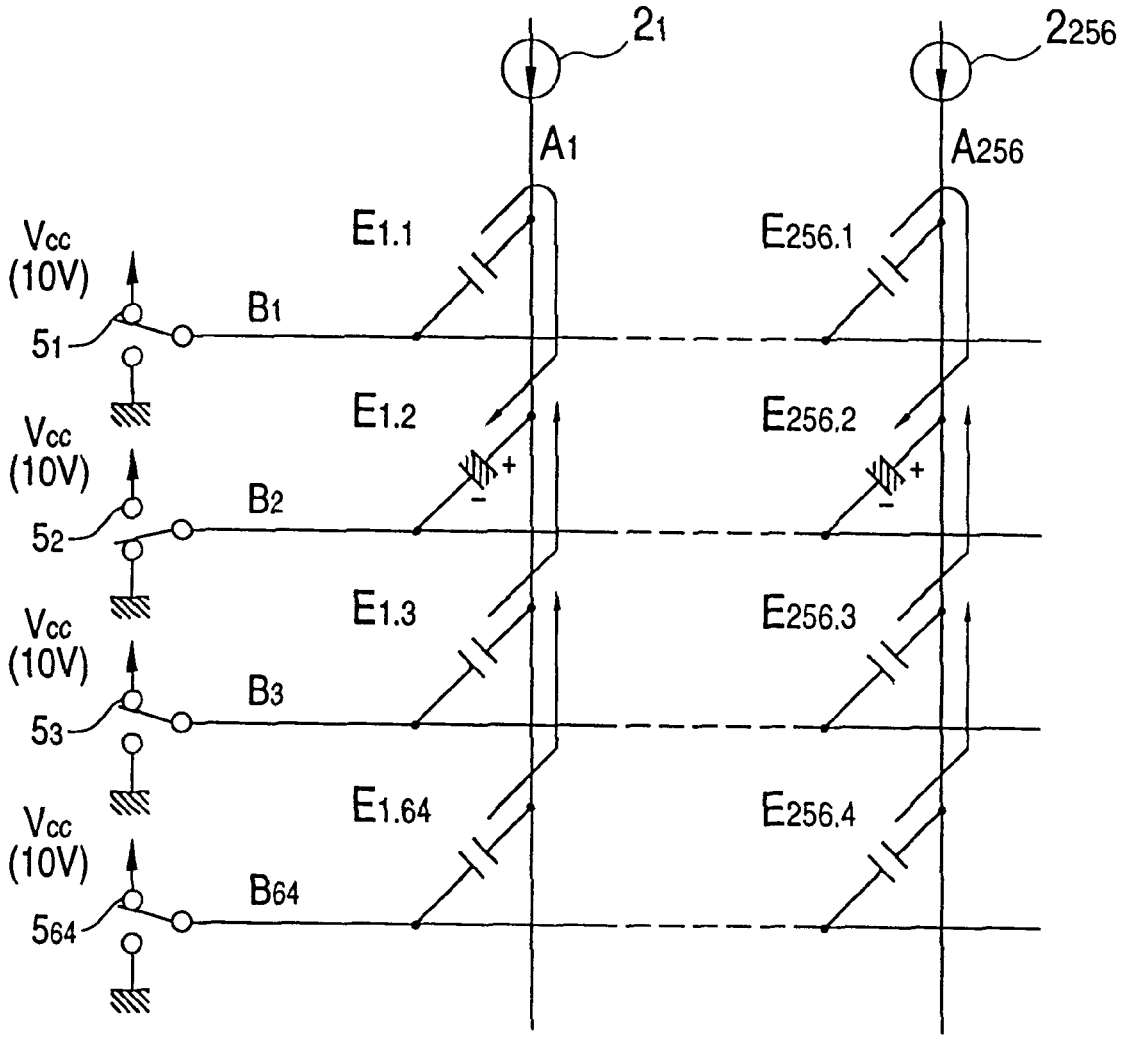
FIG. 12 PRIOR ART
FIG. 12 is a diagram for a description of difficulties accompanying the conventional luminous display.

FIG. 4 shows until a steady light emission state (light emission being carried out with a desired instantaneous luminance) after the scanning is switched. FIG. 5 shows the steady light emission state (the inter-element voltages becoming Vcc).

As shown in FIG. 4, when the scanning is shifted to the cathode line B2, the cathode line B2 which is scanned is grounded, and the cathode lines B1, and B3 through B64 which are not scanned are applied with the reverse bias voltage Vcc. And the anode lines A2 and A3 which are driven are connected to the constant current sources 22 and 23, and the anode lines A1, and A4 through A256 are grounded because the shunt switch 71 is turned on.

In this case, the potential V×2 of the anode line A2 becomes about Vcc+V2 instantaneously. Therefore, currents from the constant current source 22, and the luminous elements E2,1, and E2,3 through E2,256 flow to the luminous element E2,2, so that its parastic capacitance is quickly charged until the inter-element voltage of the luminous element E2,2 becomes Vcc.

Thereafter, as shown in FIG. 5, the flow of currents from the side of the luminous elements E2,1, and E2,3 through E2,64 is ceased, and a predetermined current I from the constant current source 22 flows to the luminous element E2,2 only. That is, the luminous element is in the steady light emission state.

The luminous elements E2,1, and E2,3 through E2,256, which are located at the intersections of the anode line A2 and the cathode lines B1, and B3 through B64 are maintained charged with positive charge so that the inter-element voltage is V2 at all the times during the scanning period.

Similarly, the potential V×3 of the anode line A3 becomes about Vcc+V3 instantaneously. Therefore, as shown in FIG. 4, currents from the constant current source 23, and from the side of the luminous elements E3,1, and E3,3 through E3,256 flow to the luminous element E3,2, and its parastic capacitance is quickly charged until the inter-element voltage of the luminous element E3,1 becomes Vcc. Thereafter, as shown in FIG. 5, the steady light emission state that a predetermined current I from the constant current source 23 flows to the luminous element E3,3 only, is established.

Furthermore, similarly, the luminous elements E3,1, and E3,3 through E3,64 which are located at the intersections of the anode line A3 and the cathode lines B1, and B3 through B64 which are not scanned are maintained charged with positive charges at all the times during the scanning period so that the inter-element voltage be V3.

To the luminous elements (for instance E1,1) located at the intersections of the cathode lines B1, and B3 through B64 which are not scanned and the anode lines A1, and A4 through A256 which are not driven, being applied with the reverse bias voltage, currents flow in the directions shown in FIG. 4. Therefore, those luminous elements are charged reversely with charges as shown in FIG. 5.

The luminous elements E1,2 and E4,2 through E256,2 connected at the intersections of the cathode line B2 which are scanned and the anode lines A1, and A4 through A256 which are not driven are each grounded at both ends. Therefore, as shown in FIG. 4, they are discharged, and as shown in FIG. 5 the parastic capacitances are not charged at all.

In the state shown in FIG. 5, the potential of the connecting point P of the luminous element E2,2 and the cathode line B2 corresponds to the drop voltage value which is obtained when currents flowing from the side of the luminous elements E2,2 and E3,2 flow the resistances r1 and r2 of the cathode line B2. Accordingly, the voltage which is obtained by subtracting the voltage drop from the potential V×2 of the anode line A2 is applied to the luminous element E2,2.

In the above-described prior art, application of the offset voltage is not carried out, and therefore the potential V×2 of the anode line A2 is Vcc, and the inter-element voltage of the luminous element E2,2 is lower than Vcc (the charges charged in the parastic capacitance of the luminous element E2,2 is such that the inter-element voltage is lower than Vcc).

Therefore, the luminous element E2,2 is not in the steady light emission state. In order to place the luminous element in the steady light emission state, it is necessary to charge the constant current source again.

On the other hand, in the case of the invention, the potential V×2 of the anode line A2 is Vcc+V2, and therefore the inter-element voltage of the luminous element E2,2 is higher than that in the case of the prior art (the parastic capacitance of the luminous element E2,2 is charged more than in the case of the prior art). Accordingly, the time required for placing the luminous element in the steady light emission state is shorter).

Furthermore, in the above-described embodiment, the offset voltage is equal to the above-described drop voltage value. Therefore, as shown in FIG. 4, the inter-element voltage of the luminous element E2,2 is quickly raised to Vcc by the flow of currents from the constant current source 22 and from the side of the luminous elements E2,1, and E2,3 through E2,64; that is, the steady light emission state is quickly obtained.

Similarly, the offset voltage V3 is set equal to the drop voltage value which is obtained when the currents from the side of the luminous elements E2,2 and E3,2 to the cathode line B2 flow the resistances r1, r2 and r3 of the cathode line. Hence, as shown in FIG. 4, the flowing of currents from the constant current source 22 and the side of the luminous elements E3,1, and E3,3 through E3,64 raises the inter-element voltage of the luminous element E3,2 to Vcc quickly; that is, the steady light emission state is obtained quickly. The time difference is substantially eliminated which is between the time instants when the luminous elements E2,2 and E3,2 are placed in the steady light emission state. Hence, the light emission is uniform in the panel.

In the embodiment, in order to apply the offset voltages V1 through V256 which are set to suitable values, the anode lines A1 through A256 are made connectable to the variable voltage sources 81 through 8256; however, it is preferable that the offset voltages are set according to the state of light emission of the luminous elements on the cathode line which is scanned. This is because, depending on which of the luminous elements connected to the cathode line which is scanned, amounts of currents flowing in the resistors r1 through r256 are determined, as a result of which drop voltage values at the resistors r1 through r256 are determined. Accordingly, the embodiment needs a means which obtains the light emission state data of the luminous elements connected to the cathode line which is scanned next in advance, and operates them thereby to determine the offset voltages V1 through V256, and a means which controls the variable voltage sources 81 through 8256 to apply the offset voltages V1 through V256.

In the above-described embodiment, the means for applying the offset voltages V1 through V256 are the variable voltage sources 81 through 8256; however, the latter may be replaced with constant voltage sources which provide predetermined voltages. In this case, it is impossible to change the offset voltages V1 through V256 according to the change in light emission state of the luminous elements, and therefore it is also impossible to compensate the drop voltages completely. However, in this case, when compared with the prior art, the steady light emission state is obtained quickly, and the panel light emission is improved in light emission uniformity.

It is necessary that the offset voltages V1 through V256 are so set that V1 is minimum and V256 is maximum—the offset voltages may be increased gradually increased towards V256 (for instance V1<V2< - - - <V256). And the offset voltages in a certain range may be equal to one another (for instance V1= - - - V50<V51=V100< - - - ).

Furthermore, no offset voltages may be applied to the luminous elements which are less affected by the resistance of the cathode line which is located near the scanning switches 51 through 564, and the offset voltages are applied only to the luminous elements which are greatly affected by the resistance of the cathode line which is located away from the scanning switches 51 through 564.

As was described above, in the luminous display and its driving method according to the invention, the fluctuation in the light emission start time of all the luminous elements which is due to the resistances of the cathode lines is minimized. Therefore, all the luminous elements are substantially uniform in luminescence; that is, the luminous display and its driving method of the invention is advantageous in that the operator is able to observe the display with ease.

What is claimed is:

1. A method of driving a luminous display in a simple matrix drive system in which luminous elements are connected at the intersections of a plurality of anode lines and a plurality of cathode lines which are arranged in matrix form, the cathode lines or the anode lines are employed as scanning lines, while the other are employed as drive lines, and while the scanning lines are scanned with a predetermined period, in synchronization with the scanning operation drive sources are connected to desired lines to cause luminous elements to emit lights which are connected at the intersections of the scanning lines and the drive lines, said method comprising:

scanning one scanning line; and during a period between the scanning of the one scanning line and the scanning of a succeeding scanning line, applying a first offset voltage to a first drive line of the drive lines to charge a first luminous element of the luminous elements and applying a second offset voltage to a second drive line of the drive lines to charge a second luminous element of the luminous elements, wherein the first offset voltage is different than the second offset voltage.

2. A method of driving a luminous display according to claim 1, wherein said offset voltage applying step comprises:

grounding the scanning lines.

3. A method of driving a luminous display according to claim 1, wherein at least the first and second offset voltages are set to values corresponding to drop voltages across resistances between the luminous elements of the scanning lines and the ends of the scanning lines.

4. A method of driving a luminous display according to claim 1, wherein at least the first and second offset voltages are set to values corresponding to resistances between the luminous elements and the ends of the scanning lines.

5. A method of driving a luminous display according to claim 1, further comprising;

applying bias voltages to the scanning lines which are not scanned during the scanning operation; and grounding the drive lines which are not driven during the scanning operation.

6. A method of driving a luminous display according to claim 1, wherein the luminous elements are organic EL elements having parasitic capacitances.

7. The method of driving a luminous display according to claim 2, further comprising:

connecting the drive lines to voltage sources different from the drive sources.

8. The method of driving a luminous display according to claim 1, wherein during the period, the first luminous element is connected to the first offset voltage via the first drive line and the first luminous element is connected to ground via one of the scanning lines.

9. The method of driving a luminous display according to claim 8, wherein during the period, the second luminous element is connected to the second offset voltage via the second drive line and the second luminous element is connected to ground via one of the scanning lines.

10. The method of driving a luminous display according to claim 1, further comprising:

applying at least one drive voltage to at least one of the first and second drive lines during the scanning operation.

11. The method of driving a luminous display according to claim 10, wherein the at least one drive voltage is different from the first and second offset voltages.

12. The method of driving a luminous display according to claim 1, wherein the first and second offset voltages are set to values corresponding to the state of light emission of the luminous elements on the one scanning line which is scanned.

13. A luminous display in a simple matrix drive system, said display comprising:

a plurality of anode lines;

a plurality of cathode lines, said cathode lines and anode lines being arranged in matrix form, ones of said cathode lines and said anode lines being employed as scanning lines, and the others being employed as drive lines;

a plurality of luminous elements connected at intersections of said anode lines and said cathode lines;

bias voltage applying means for applying bias voltage to the scanning lines, each of the scanning lines is connected to one of said voltage applying means and the ground;

constant current sources for supplying drive currents to said luminous elements via said drive lines; and at least one voltage source for applying a first offset voltage to a first drive line of the drive lines to charge a first luminous element of the luminous elements and for applying a second offset voltage to a second drive line of the drive lines to charge a second luminous element of the luminous elements, said anode lines being connected to one of said constant current sources, said voltage sources, and ground, wherein the first offset voltage is different than the second offset voltage, wherein said scanning lines are scanned with a predetermined period and desired drive lines are driven in synchronization with the scanning operation to cause said luminous elements to emit lights, and wherein the at least one voltage source respectively applies the first offset voltage and the second offset voltage to the first drive line and the second drive line during an offset period between scanning the scanning lines.

14. A luminous display according to claim 13, wherein during the offset period the scanning lines are grounded.

15. A luminous display according to claim 13, wherein at least the first and second offset voltages are set to values corresponding to drop voltages across resistances between the luminous elements of the scanning lines and the ends of the scanning lines.

16. A luminous display according to claim 13, wherein the at least one voltage source comprises variable voltage sources, and wherein the luminous display, further comprises:

voltage determining means which, according to the light emission states of all the luminous elements connected to the cathode line which is to be scanned next, determine at least the first and second offset voltages which are to be applied to those luminous elements; and voltage control means for controlling supply voltage values of the variable voltage sources so as to apply at least the first and second offset voltages which are determined by the offset voltage determining means.

17. A luminous display according to claim 13, wherein the first and second offset voltages are set in correspondence to resistances between the luminous elements and the end of the scanning lines.

18. A luminous display according to claim 13, wherein during a scanning period of the scanning lines, the lines which are not scanned are connected to the bias voltage applying means, and the lines which are not driven are grounded.

19. A luminous display according to claim 13, wherein the luminous elements are organic EL elements having capacitances.

20. The luminous display according to claim 13, wherein the first and second offset voltage are set to values corresponding to the state of light emission of the luminous elements on the one scanning line which is scanned.

21. A method of driving a luminous display comprising a scanning circuit having a plurality of scanning lines, a driving circuit having a plurality of drive lines, a plurality of luminous elements wired in the form of matrix made of said scanning lines and said drive lines, and a light emission control circuit which controls said scanning circuit and said driving circuit, said method comprising;

scanning a first scanning line;

driving said drive lines in synchronism with said first scanning line;

applying a first offset voltage to a first drive line and a second offset voltage to a second drive line during a period between the end of scanning the first scanning line and the start of scanning a second scanning line;

wherein the first offset voltage is different than the second offset voltage.

22. The method of driving a luminous display according to claim 21, wherein the first offset voltage is supplied to a first luminous element of the luminous elements to charge the first luminous element and the second offset voltage is supplied to a second luminous element of the luminous elements to charge the second luminous element.

23. The method of driving a luminous display according to claim 21, applying at least one drive voltage to at least one of the first and second drive lines when the first scanning line is scanned.

24. The method of driving a luminous display according to claim 23, wherein the at least one drive voltage is different from the first and second offset voltages.

25. The method of driving a luminous display according to claim 21, wherein the first and second offset voltages are set to values corresponding to drop voltages between the scanning circuit and the driving circuit.

26. The method of driving a luminous display according to claim 21, wherein the first and second offset voltages are set to values corresponding to the state of light emission of the luminous elements.

27. A luminous display comprising;

a scanning circuit connecting a plurality of scanning lines, a driving circuit connecting a plurality of drive lines, a plurality of luminous elements wired in the form of a matrix made of said scanning lines and said drive lines, a light emission control circuit which controls said scanning circuit and said driving circuit, wherein said light emission control circuit controls said scanning circuit so as to apply a first offset voltage to a first drive line and a second voltage offset to a second drive line during a period between the end of scanning the first scanning line and the start of scanning a second scanning line;

wherein the first offset voltage is different than the second offset voltage.

28. The luminous display according to claim 27, wherein the first offset voltage is supplied to a first luminous element of the luminous elements to charge the first luminous element and the second offset voltage is supplied to a second luminous element of the luminous elements to charge the second luminous element.

29. The luminous display according to claim 27, wherein the driving circuit applies at least one drive voltage to at least one of the first and second drive lines when the first scanning line is scanned.

30. The luminous display according to claim 29, wherein the at least one drive voltage is different from the first and second offset voltages.

31. The luminous display according to claim 27, wherein the first and second offset voltages are set to values corresponding to drop voltages between the scanning circuit and the driving circuit.

32. The luminous display according to claim 27, wherein the first and second offset voltages are set to values corresponding to the state of light emission of the luminous elements.

33. The luminous display according to claim 27, wherein said driving circuit has a current source and variable voltage source for each drive line.

* * * * *